United States Patent [19]

Okazaki et al.

[11] Patent Number: 4,552,837

[45] Date of Patent: Nov. 12, 1985

[54] SILVER HALIDE PHOTOGRAPHIC EMULSIONS

[75] Inventors: Masaki Okazaki; Osami Tanabe; Satoshi Nagaoka; Yuji Mihara; Toshinao Ukai, all of Kanagawa, Japan

[73] Assignee: Fuji Photo Film Co., Ltd., Kanagawa, Japan

[21] Appl. No.: 598,945

[22] Filed: Apr. 11, 1984

[30] Foreign Application Priority Data

Apr. 11, 1983 [JP] Japan ..... 58-63408

[51] Int. Cl.[4] ..... G03C 7/26; G03C 1/02

[52] U.S. Cl. ..... 430/550; 430/572; 430/573; 430/576; 430/591; 430/613; 430/614

[58] Field of Search ..... 430/572, 573, 576, 591, 430/600, 614, 550, 613

[56] References Cited

U.S. PATENT DOCUMENTS

| | | | |
|---|---|---|---|
| 2,288,226 | 6/1942 | Carroll et al. | 430/572 |
| 3,583,870 | 6/1971 | Gilman | 430/576 |
| 4,135,931 | 1/1979 | Yoneyama et al. | 430/446 |

FOREIGN PATENT DOCUMENTS 52-18311 10/1977 Japan .

OTHER PUBLICATIONS

Chemical Abstracts, vol. 87, Item 93506d, 1977.

*Primary Examiner*—J. Travis Brown

*Attorney, Agent, or Firm*—Sughrue, Mion, Zinn, Macpeak, and Seas

[57] ABSTRACT

A silver halide color photographic emulsion is described, containing at least one sensitizing dye represented by formula (I) and at least one compound represented by formula (II). The use of compounds of formula (I) in combination with compounds of formula (II) permits the spectral sensitization of photographic emulsions without extending the wavelength region of spectral sensitivity, enabling the production of a light-sensitive material of high sensitivity and reduced fog.

(I)

(II)

(The symbols V, $W_1$, $W_2$, $R_1$, $R_2$, $R_3$, X, n, $R_5$, Y, $X_1$, $m_1$ and $m_2$ are as defined in the appended claims).

17 Claims, No Drawings

SILVER HALIDE PHOTOGRAPHIC EMULSIONS

FIELD OF THE INVENTION

The present invention relates to spectrally sensitized silver halide photographic emulsions and more particularly to silver halide photographic emulsions which are increased in spectral sensitivity of the green-sensitive region.

BACKGROUND OF THE INVENTION

It is known that a technique to extend the light-sensitive wavelength region of silver halide photographic emulsions to a longer wavelength side by adding certain cyanine dyes, i.e., spectral sensitization, is applied as one of the techniques for the production of photographic light-sensitivite materials. It is also known that the sensitivity obtained by this spectral sensitization, i.e., spectral sensitivity, is affected by the chemical structure of sensitizing dyes, and the properties of the emulsions used such as with respect to the halogen composition, crystal habit and crystal system of silver halide, a silver ion concentration, and a hydrogen ion concentration. The spectral sensitivity is further influenced by photographic additives such as stabilizers, antifoggants, coating aids, precipitating agents, color couplers, and hardening agents.

In general, a sensitizing dye is used for sensitization of a given spectral wavelength of light-sensitive materials. It is known that in some cases when this sensitizing dye is used in combination with another specifically selected dye or organic substance, the efficiency of spectral sensitization can be markedly increased. This is called super sensitization. This super sensitization can be said to be a unique phenomenon since, in general, addition of such secondary dyes or organic substances does not often result in an increase of the sensitivity, or rather even lowers the sensitivity. Secondary sensitizing dyes or organic substances which can be used for this super sensitization are very specific. For example, an apparently small difference in chemical structure may exert considerable influence on the super sensitization action. Thus it is very difficult or impossible to predict suitable combinations of dyes for super sensitization based on their chemical structures.

Sensitizing dyes as used in silver halide photographic emulsions for super sensitization should very desirably satisfy several requirements.

One of the requirements is to provide a high spectral sensitivity. It is desired for them to strongly sensitize a specific narrow wavelength region. In particular, in spectral sensitization of the green-sensitive region, it is necessary to increase the sensitivity within a narrow wavelength region. The reason for this is that in the spectral sensitization of the green-sensitive region, if the spectral sensitivity is extended to a longer wavelength region or a shorter wavelength region, overlapping of the green-sensitive region and the red-sensitive region or blue-sensitive region is increased: in color light-sensitive materials, such overlapping increases color turbidity, and, in some cases, increases the sensitivity to safe light, making it difficult to handle such light-sensitive materials.

For this reason, sensitizing dyes providing spectral sensitivity called "J-bands" are usually used. It is desired for the green-sensitivity to be increased without extending the wavelength region of the spectral sensitivity, or preferably while narrowing it.

Another requirement is to cause no undesirable interaction with color couplers and other photographic additives, and further to maintain stable photographic characteristics during the storage of light-sensitive materials.

Another requirement is not to leave any residual color resulting from the sensitizing dyes in the light-sensitive materials after the processing thereof. The elimination of such residual color is required particularly in the rapid processing in which the processing is performed in short periods of time, usually from several to several tens of seconds.

Another requirement is that fog resulting from the sensitizing dyes should be low.

Dye combinations exhibiting super sensitization particularly in the green-sensitive region are described, for example, in U.S. Pat. Nos. 3,580,724, 3,729,319, and 3,397,060. These conventional dye combinations, however, fail to provide light-sensitive materials which are of high green sensitivity, and simultaneously in which the fog is low, the storage stability is good, and the residual color after the processing is sufficiently low.

SUMMARY OF THE INVENTION

An object of the invention is to provide a silver halide photographic emulsion spectrally sensitized so that the green sensitivity is high.

Another object of the invention is to provide a silver halide photographic emulsion spectrally sensitized so as to provide a high green sensitivity without extending the wavelength region of the spectral sensitivity.

Still another object of the invention is to provide a spectrally sensitized silver halide photographic emulsion which shows reduced changes in photographic characteristics such as sensitivity and fog during the storage.

It has been found that the objects are attained by using at least one sensitizing dye represented by formula (I) as described hereinafter in combination with at least one compound represented by formula (II) as described hereinafter.

The present invention relates to a silver halide photographic emulsion containing a combination of at least one sensitizing dye represented by formula (I);

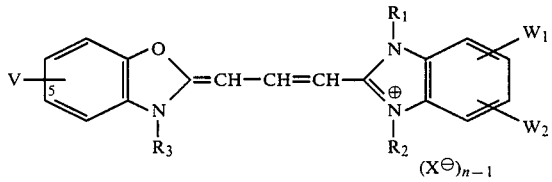

and at least one compound represented by formula (II):

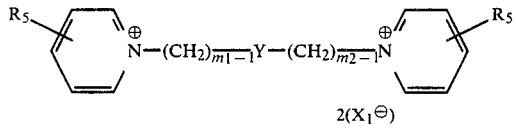

DETAILED DESCRIPTION OF THE INVENTION

In formula (I), V is a hydrogen atom, an alkyl group having 1 to 8 carbon atoms (e.g., a methyl group, an ethyl group, a propyl group, or a butyl group), an alkoxyl having 1 to 8 carbon atoms (e.g., a methoxy group, an ethoxy group, a propoxy group, and a butoxy group), a halogen atom (e.g., a chlorine atom or a bromine atom), a phenyl group, a carboxyl group, a hydroxyl grup, or an alkoxycarbonyl group having 2 to 8 carbon atoms (e.g., a methoxycarbonyl group and an ethoxycarbonyl group). It is preferably located at the 5- or 6-position, and more preferably the 5-position. It may also form a condensed benzene ring (e.g., a 4,5-benzo ring).

$W_1$ and $W_2$ may be the same or different and are each a hydrogen atom, a halogen atom (e.g., a chlorine atom, a bromine atom, and a fluorine atom), an aliphatic hydrocarbon group (specifically an alkyl group, an allyl group and a cyclic alkyl group, and preferably having 6 or less carbon atoms, such as a methyl group, an ethyl group, an allyl group, and a cyclohexyl group), an acyl group having 8 or less carbon atoms (e.g., an acetyl group, a benzoyl group, and a mesyl group), an acyloxy group having 3 or less carbon atoms (e.g., an acetoxy group), an alkoxycarbonyl group having 8 or less carbon atoms (e.g., a methoxycarbonyl group, an ethoxycarbonyl group, and a benzyloxycarbonyl group), a carbamoyl group, a substituted carbamoyl group preferably having 2 to 12 carbon atoms (e.g., an N,N-dimethylcarbamoyl group, a morpholinocarbonyl group, and a piperidinocarbonyl group), a sulfamoyl group, a substituted sulfamoyl group, preferably having 1 to 12 carbon atoms (e.g., an N,N-dimethylsulfamoyl group, a morpholinosulfonyl group, and a piperidinosulfonyl group), a cyano group, a trifluoromethyl group, a hydroxyl group, or an alkylsulfonyl group having 1 to 4 carbon atoms (e.g., a methanesulfonyl group and an ethanesulfonyl group).

$R_1$, $R_2$ and $R_3$ may be the same or different and are each an alkyl group having 8 or less carbon atoms (e.g., a methyl group, an ethyl group, a propyl group, an allyl group, a butyl group, a pentyl group, and a cyclohexyl group), or a substituted alkyl group, i.e., an alkyl group having 6 or less carbon atoms, preferably 4 or less carbon atoms, which is substituted by one or more of groups such as $COO^-$ or COOM, $—SO_3^-$ or $SO_3M$ (wherein M represents H, Na and K), —COOH.A, $—SO_3H.A$ (wherein A represents an organic base such as an amine compound i.e., a trialkyl amine having 1–6 carbon atoms in an alkyl moiety, a cyano group, a halogen atom (e.g., a fluorine atom, a chlorine atom, and a bromine atom), a hydroxyl group, an alkoxycarbonyl group having 8 or less carbon atoms (e.g., a methoxycarbonyl group, an ethoxycarbonyl group, and a benzyoxycarbonyl group), an alkoxy group having 7 or less carbon atoms (e.g., a methoxy group, an ethoxy group, a propoxy group, a butoxy group, and a benzyloxy group), an aryloxy group preferably having 6–16 carbon atoms (e.g., a phenoxy group and a p-tolyloxy group), an acyloxy group having 3 or less carbon atoms (e.g., an acetyloxy group and a propionyloxy group), an acyl group having 8 or less carbon atoms (e.g., an acetyl group, a propionyl group, a benzoyl group, and a mesyl group), a carbamoyl group, a substituted carbamoyl group preferably having 2 to 12 carbon atoms (e.g., an N,N-dimethylcarbamoyl group, a morpholinocarbamoyl group, and a piperidinocarbamoyl group), a sulfamoyl group, a substituted sulfamoyl group preferably having 1–12 carbon atoms (e.g., an N,N-dimethylsulfamoyl group, a morpholinosulfonyl group, and a piperidinosulfonyl group), and an aryl group and a substituted aryl group preferably having 6–16 carbon atoms in an aryl moiety (e.g., a phenyl group, a p-hydroxyphenyl group, a p-carboxyphenyl group, a p-sulfophenyl group, and an α-naphthyl group).

At least one of $R_2$ and $R_3$ is a substituted alkyl group containing a sulfo group or a carboxyl group. More preferably both of $R_2$ and $R_3$ are substituted alkyl groups containing a sulfo group or a carboxyl group.

X is an acid anion (e.g., Cl, F, Br, I, p-toluene sulfonic acid, p-chlorobenzene sulfonic acid, ethyl sulfuric acid or perchlorate anion).

n is 1 when the sensitizing dye of the general formula (I) forms an intramolecular salt, and in other cases, it is 2.

In formula (I), $W_1$ and $W_2$ each is especially preferred to be a halogen atom, a cyano group, or a trifluoromethyl group. V is a phenyl group, a halogen atom, or a condensed benzene ring.

In formula (II), $R_5$ is a hydrogen atom, a halogen atom (e.g., a fluorine atom, a chlorine atom, a bromine atom, and an iodine atom), an alkyl group having 1 to 18 carbon atoms (e.g., a methyl group, an ethyl group, and a propyl group), an alkoxycarbonyl group having 2 to 18 carbon atoms (e.g., a methoxycarbonyl group, an ethoxycarbonyl group, a butoxycarbonyl group, and a benzyloxycarbonyl group), an acyloxy group having 1 to 18 carbon atoms (e.g., an actyloxy group, a propionyloxy group, a benzoyloxy group, and a cyclohexylcarbonyloxy group), an alkoxy group having 1 to 18 carbon atoms (e.g., a methoxy group, an ethoxy group, a propoxy group, and a butoxy group), an amino group, a substituted amino group (e.g., an alkyl or dialkyl amino group preferably having 1 to 10 carbon atoms in an alkyl moiety, such as a methylamino group, an ethylamino group, a propylamino group, a dimethylamino group, a dodecylamino group; a cyclohexylamino group, a β-hydroxyethylamino group, an anilino group, a p-anisylamino group, an o-toluidino group, and a 2-benzothiazolylamino group), an acylamide group preferably having 2 to 10 carbon atoms (e.g., an acetylamide group, a propionylamide group, and a benzoylamide group, an alkane sulfonylamide preferably having carbon atoms of less than 12 (e.g., a methanesulfonylamide group), or a carbamoyl group, a substituted carbamoyl group preferably having 2 to 12 carbon atoms (e.g., an alkyl or dialkylcarbamoyl group such as an N,N-dimethylcarbamoyl group; a morpholinocarbonyl group; and a piperidinocarbonyl group).

Y is an alkylene group having 1 to 18 carbon atoms, an arylene group having 6 to 18 carbon atoms, an aralkylene group having 7 to 18 carbon atoms, —COO—, or $—COO—Y_1—OCO—$.

$Y_1$ is an alkylene group having 1 to 18 carbon atoms, an arylene group having 6 to 18 carbon atoms, or an aralkylene group having 7 to 18 carbon atoms.

$X_1$ is an anion (e.g., Cl, F, Br, I, p-toluene sulfonic acid, p-chlorobenzene sulfonic acid, ethyl sulfuric acid or perchlorate anion).

$m_1$ and $m_2$ may be the same or different and are each an integer of 1 to 19.

Typical examples of the sensitizing dyes represented by formula (I) are shown below, although the present invention is not limited thereto.

I-1
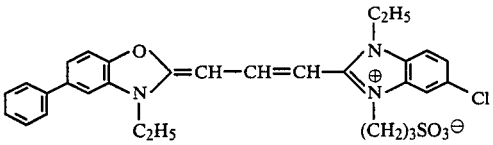
I-2
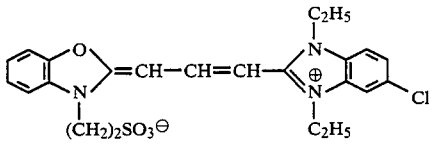
I-3
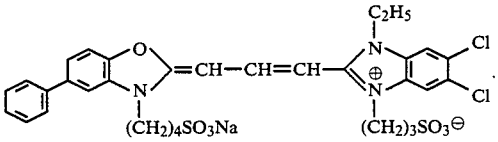
I-4
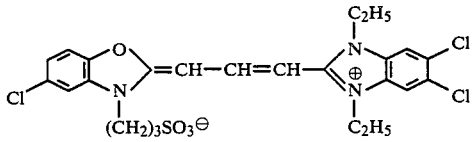
I-5
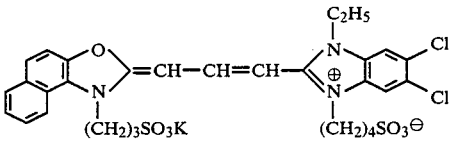
I-6
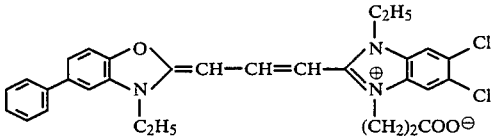
I-7
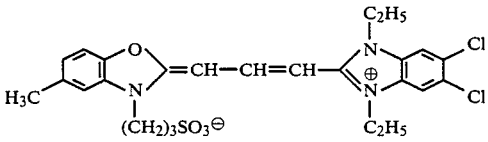
I-8
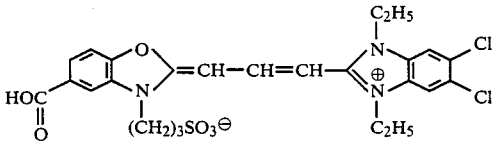
I-9
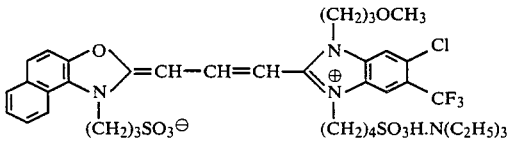
-continued
I-10
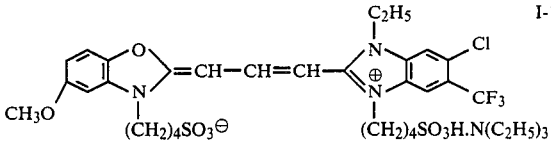
I-11
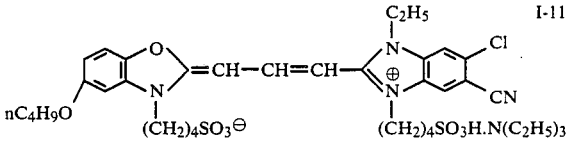
I-12
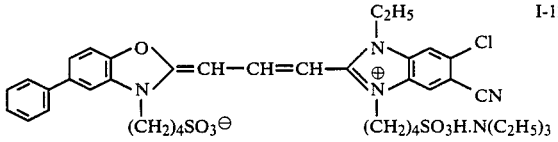
I-13
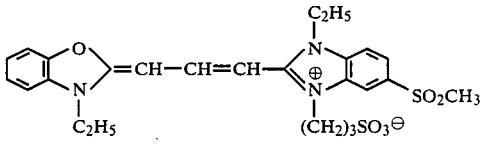
I-14
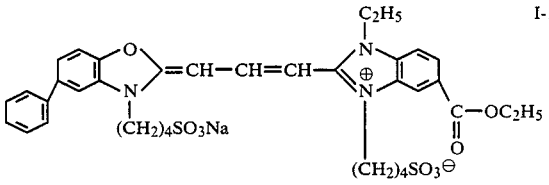
I-15
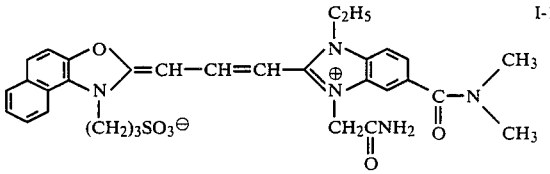
I-16
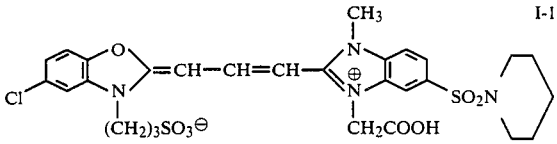
I-17
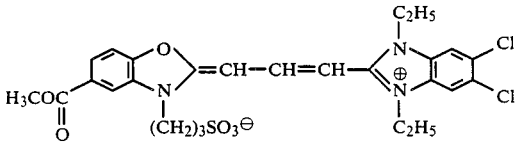
Typical examples of the compounds represented by formula (II) are shown below, although the present invention is not limited thereto.
II-1
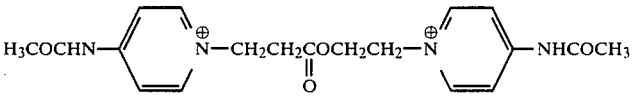
2Br⊖
II-2
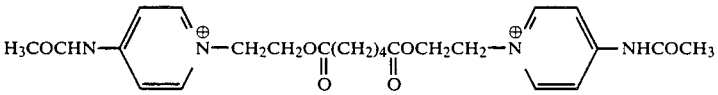
2Br⊖

-continued

II-3 $2Cl^{\ominus}$

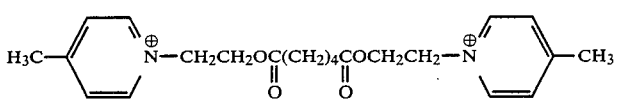

II-4 $2Cl^{\ominus}$

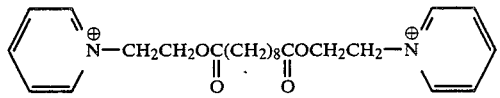

II-5 $2Br^{\ominus}$

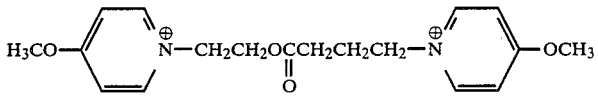

II-6 $2Br^{\ominus}$

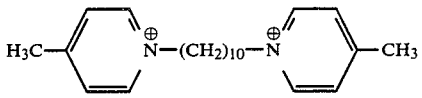

II-7 $2Cl^{\ominus}$

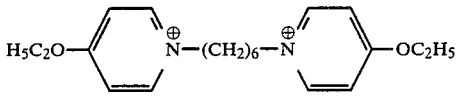

II-8 $2Br^{\ominus}$

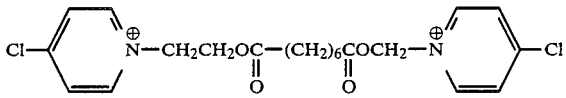

II-9 $2Br^{\ominus}$

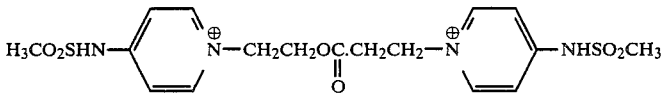

II-10 $2Br^{\ominus}$

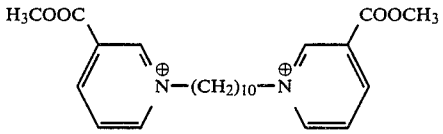

II-11 $2I^{\ominus}$

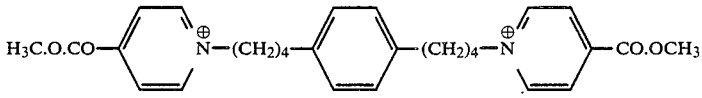

II-12 $2Br^{\ominus}$

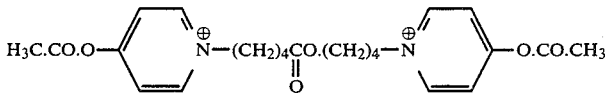

II-13 $2Br^{\ominus}$

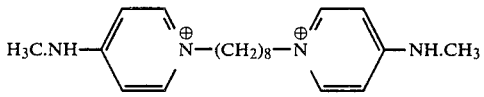

II-14 $2Br^{\ominus}$

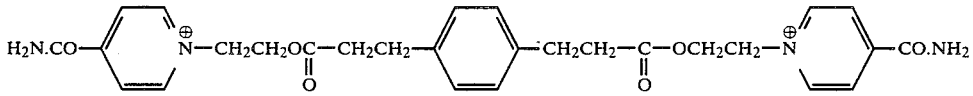

The sensitizing dyes of formula (I) as used herein are known compounds and can be easily prepared by the methods described in Japanese Patent Publication No. 7828/63, F. M. Hamer, *Heterocyclic Compounds-Cyanine Dyes and Related Compounds,* Chapter V, pages 116–147 published by John Wiley & Sons Corp. (New York, London) (1964), and D. M. Sturmer, *Heterocyclic Compounds-Special Topics in Heterocyclic Chemistry,* Chapter VIII, Section IV, pages 482–515, published by John Wiley & Sons, Corp. (New York, London) (1977).

The compounds of formula (II) are also known compounds and can be easily prepared with reference to the method described in Japanese Patent Application (OPI) No. 44025/78 (corresponding to U.S. Pat. No. 4,135,931; the term "OPI" as used herein means a "published unexamined Japanese patent application").

The sensitizing dye as used herein is incorporated into the silver halide photographic emulsion in an amount of from $1\times10^{-6}$ to $5\times10^{-3}$ mole, preferably from $1\times10^{-5}$ to $2.5\times10^{-3}$ mole, and more preferably from $4\times10^{-5}$ to $1\times10^{-3}$ mole per mole of silver halide in the silver halide emulsion being sensitized.

The sensitizing dye as used herein can be dispersed directly in the silver halide emulsion. A procedure can also be employed in which the sensitizing dye is first dissolved in a suitable solvent, such as methyl alcohol, ethyl alcohol, methyl cellosolve, acetone, water, pyridine, and mixed solvents thereof, and the resulting solution is then added to the emulsion. Supersonic waves can be applied in dissolving the sensitizing dye. In addition, the following procedures can be employed, a method as described, for example, in U.S. Pat. No. 3,469,987, in which the sensitizing dye is dissolved in a volatile organic solvent, the resulting solution is dispersed in a hydrophilic colloid, and the dispersion thus formed is added to the emulsion; a method as described, for example, in Japanese Patent Publication No. 24185/71 (corresponding to U.S. Pat. No. 3,676,147), in which a water-insoluble dye is directly dispersed in a water-soluble solvent and the resulting dispersion is added to the emulsion; a method as described, for example, in U.S. Pat. No. 3,822,135, in which the dye is dissolved in a surfactant and the solution thus formed is added to the emulsion; a method as described, for example, in Japanese Patent Application (OPI) No. 74624/76 (corresponding to British Pat. No. 1,528,150) in which the dye is dissolved using compounds capable of red shifting and the resulting solution is added to the emulsion; and a method as described, for example, in Japanese Patent Application (OPI) No. 80826/75 (corresponding to British Pat. No. 1,484,479), in which the dye is dissolved in a substantially water-free acid and the solution thus formed is then added to the emulsion. Furthermore, the methods described, for example, in U.S. Pat. Nos. 2,912,343, 3,342,605, 2,996,287, and 3,429,835 can also be employed.

The sensitizing dye may be uniformly dispersed in the silver halide emulsion prior to coating on a suitable support and, of course, can be dispersed at any stage of the preparation of the silver halide emulsion.

The compound of formula (II) is advantageous to use in an amount of from about 0.01 to about 10 m moles, more advantageous to use about 0.2 to about 2.5 m moles per mole of silver halide contained in the emulsion.

The weight ratio of the dye of formula (I) to the compound of formula (II) is preferably from 4:1 to 1:100 and more preferably from 2:1 to 1:40.

The compound of formula (II) can be dispersed directly in the emulsion. A method can also be used in which the compound is dissolved in a suitable solvent, such as methyl alcohol, ethyl alcohol, methyl cellosolve, and water, or mixed solvents thereof, and then added to the emulsion. Furthermore, as in the addition of the sensitizing dyes, the compound of formula (II) can be added to the emulsion in the form of a solution or a dispersion in a colloid. Moreover, the method described in Japanese Patent Application (OPI) No. 80119/75 can be employed.

In the present invention, other sensitizing dyes can further be used in combination with the sensitizing dyes of formula (I). For example, the sensitizing dyes described in U.S. Pat. Nos. 2,688,545, 3,397,060, 3,416,927, 3,615,613, 3,615,632, 3,615,635, 3,617,295, 3,628,964, 3,635,721, 3,703,377, British Pat. Nos. 1,242,588, 1,293,862, and Japanese Patent Publication Nos. 4930/68, 4936/68, 14030/69 and 10773/68.

Silver halide as used herein may be any of silver chloride, silver bromide, silver iodide, silver chlorobromide, silver chloroiodide, silver iodobromide, silver chlorobromoiodide, and so forth. Of these compounds, silver chlorobromide and silver iodobromide are especially preferred in the present invention.

The silver halide may be in the form of coarse grains or finely divided grains, or a mixture thereof. These silver halide grains are formed by the known techniques such as the single jet method, the double jet method, or the controlled double jet method.

The crystal structure of the silver halide grains may be such that it is uniform through the whole thereof, or may be a layer-structure in which the inner and outer portions are different from each other, or may be of the so-called conversion type described in British Pat. No. 635,841 and U.S. Pat. No. 3,622,318. These silver halide grains may be of the type that a latent image is formed mainly on the surface of the grains or of the inner latent image type that the latent image is formed in the interior of the grains.

Photographic emulsions can be prepared by various methods such as the ammonia method, the neutral method, and the acid method, which are generally recognized and described, for example, in Mees. *The Theory of Photographic Process,* MacMillan Publishing Co., 1977 and Glafikides, *Photographic Chemistry,* Fauntain Press Corp.

When these silver halide grains are formed, they are washed with water to remove by-produced water-soluble salts (e.g., potassium nitrate in the preparation of silver bromide from silver nitrate and potassium bromide) and then are subjected to a heat treatment in the presence of chemical sensitizers to increase the sensitivity without coarsening the grains. In this case, the by-produced water-soluble salts may not be removed. General methods of treatment are described in the texts noted in the preceding paragraph.

The mean grain size (as determined, for example, by the projected area method and expressed as a number-average value) of silver halide grains is preferably from about 0.04 to $4\mu$.

In order to control the growth of silver halide grains at the time of formation thereof, silver halide solvents such as ammonia, potassium rhodanide, antimony rhodanide, thioether compounds (as described in U.S. Pat. Nos. 3,271,157, 3,574,628, 3,704,130, 4,297,439, and 4,276,374), thion compounds (as described in Japanese Patent Application (OPI) Nos. 144319/78, 82408/78, and 77737/80), amine compounds (as described in Japanese Patent Application (OPI) No. 100717/79), and so forth can be used.

Commonly used chemical sensitization methods can also be applied to the silver halide photographic emulsion such as gold sensitization (see, for example, U.S. Pat. Nos. 2,540,085, 2,597,876, 2,597,915, and 2,399,083), sensitization utilizing Group VIII metal ions (see, for example, U.S. Pat. Nos. 2,448,060, 2,540,086, 2,566,245, 2,566,263, and 2,598,079), sulfur sensitization (see, for example, U.S. Pat. Nos. 1,574,944, 2,278,947, 2,410,689, 2,440,206, 3,189,458, and 3,415,649), reduction sensitization (see, for example, U.S. Pat. No. 2,419,974, 2,518,698, and 2,983,610), and sensitization utilizing thioether compounds (see, for example, U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,574,709, 3,625,697, 3,635,717, 3,671,260, and 4,198,240). These chemical sensitization methods can be applied singly or in combination with each other.

Typical chemical sensitizers include sulfur sensitizers such as allyl thiocarbamide, thiourea, sodium thiosulfate, and cystein, noble metal sensitizers such as potassium chloraurate, aurous thiosulfate, and potassium chloropalladate, and reduction sensitizers such as tin chloride, phenylhydrazine, and reductone.

In addition, sensitizers such as polyoxyethylene derivatives (as described, for example, in British Pat. No. 981,470, Japanese Patent Publication No. 6475/56, and U.S. Pat. No. 2,716,062), polyoxypropylene derivatives, and derivatives containing a quaternary ammonium group can be used.

To the photographic emulsions as used herein can be added various compounds to prevent a reduction in sensitivity and the formation of fog during the production, storage or processing of light-sensitive materials. It is known that a wide variety of compounds can be used for this purpose, including nitrobenzimidazole, ammonium chloroplatinate, 4-hydroxy-6-methyl-1,3,3a,7-tetraazaindene, 3-methylbenzothiazole, 1-phenyl-5-mercaptotetrazole, and other heterocyclic compounds, mercury-containing compounds, mercapto compounds, and metal salts. Examples of compounds which can be used are described in K. Mees. *The Theory of The Photographic Process,* 3rd ed., (1966), pages 344–349. In this reference it is disclosed that the following compounds can be used: thiazolium salts as described in U.S. Pat. Nos. 2,131,038 and 2,694,716: azaindenes as described in U.S. Pat. Nos. 2,444,605 and 2,886,437: urazoles as described in U.S. Pat. No. 3,287,135: sulfocatechols as described in U.S. Pat. No. 3,236,652: oxims as described in British Pat. No. 623,448: mercaptotetrazoles as described in U.S. Pat. Nos. 2,403,927, 3,266,897, and 3,397,987: nitron:nitroindazoles:polyvalent metal salts as described in U.S. Pat. No. 2,839,405: thiuronium salts as described in U.S. Pat. No. 3,220,839; and palladium, platinum and gold salts as described in U.S. Pat. Nos. 2,566,263 and 2,597,915.

In the silver halide photographic emulsions as used herein, developing agents such as hydroquinones, catechols, aminophenols, 3-pyrazolidones, ascorbic acid and its derivatives, reductones and phenylenediamines can be used singly or in combination with each other. These developing agents can be incorporated into silver halide emulsion layers and/or other photographic layers such as a protective layer, an intermediate layer, a filter layer, an antihalation layer, and a back layer. The developing agents can be added in the form of solutions in suitable solvents, or of dispersions as described in U.S. Pat. No. 2,592,368 and French Pat. No. 1,505,778.

Hardening of emulsions can be achieved in the usual manner. Hardening agents which can be used include:

aldehyde compounds such as formaldehyde and glutaraldehyde;

ketone compounds such as diacetyl and cyclopentadione;

reactive halogen-containing compounds such as bis(2-chloroethylurea), 2-hydroxy-4,6-dichloro-1,3,5-triazine, and compounds as described in U.S. Pat. Nos. 2,732,303, 3,288,775, British Pat. Nos. 974,723 and 1,167,207;

reactive olefin-containing compounds such as divinylsulfone, 5-acetyl-1,3-diacryloylhexahydro-1,3,5-triazine, and compounds as described in U.S. Pat. Nos. 3,232,763, 3,635,718, and British Pat. No. 994,869;

N-methylol compounds such as N-hydoxymethylphthalimide and compounds as described in U.S. Pat. Nos. 2,586,168 and 2,732,316;

isocyanates as described in U.S. Pat. No. 3,103,437;

aziridine compounds as described in U.S. Pat. Nos. 2,983,611 and 3,017,280;

acid derivatives as described in U.S. Pat. Nos. 2,725,294 and 2,725,295;

carbodiimido compounds as described in U.S. Pat. No. 3,100,704;

epoxy compounds as described in U.S. Pat. No. 3,091,537;

isooxazole compounds as described in U.S. Pat. Nos. 3,321,313 and 3,543,292;

halogenocarboxyaldehydes such as mucochloric acid; and dioxane derivatives such as dihydroxydioxane and dichlorodioxane.

As inorganic hardening agents, chromium alum, zirconium sulfate and so forth can be used.

In place of the above-described compounds, precursors such as alkali metal/bisulfite adducts, methylol derivatives hydantoin, primary aliphatic nitroalcohols, and so forth may be used.

Surfactants may be added, singly or in combination with each other, to the photographic emulsions as used herein.

These surfactants are used as coating aids. In some cases, they are applied for ohter purposes such as acceleration of emulsification and dispersion, improvement of photographic characteristics, such as sensitization, prevention of charging, and prevention of adhesion. Surfactants which can be used include natural surfactants such as saponin, nonionic surfactants such as alkylene oxide, glycerine, and glycidol-based surfactants; cationic surfactants such as higher alkylamines, quaternary ammonium salts, pyridine and other heterocyclic compounds, and phosphonium or sulfonium compounds; anionic surfactants containing acidic groups such as carboxylic acid, sulfonic acid, phosphoric acid, a sulfonic acid ester group, and a phosphoric acid ester group; and amphoteric surfactants such as amino acids, aminosulfonic acids, and sulfuric acid or phosphoric acid esters of aminoalcohol.

Examples of surfactants which can be used are described in U.S. Pat. Nos. 2,240,472, 2,271,623, 2,288,226, 2,739,891, 3,068,101, 3,158,484, 3,201,253, 3,210,191, 3,294,540, 3,415,649, 3,441,413, 3,442,654, 3,475,174, 3,545,974, German Patent Application No. 1,942,665, British Pat. Nos. 1,077,317, 1,198,450, R. Oda et al., *Kaimen Kasseizai No Gosei To Sono Oyo* (*Synthesis of Surfactants and their Uses*), published by Maki Shoten, Tokyo, (1964), A. W. Perry, *Surface Active Agents,* Interscience Publication Corp., (1958), J. P. Sisley, *Encyclopedia of Surface Active Agents,* Vol. 2, Chemical Publishing Co., 1964, and so forth.

To the photographic emulsions as used herein there can be added, as a protective colloid, as well as gelatin, acylated gelatin such as phthalated gelatin and malonated gelatin, cellulose compounds such as hydroxyethyl cellulose and carboxymethyl cellulose, soluble starch such as dextrin, and hydrophilic polymers such as polyvinyl alcohol, polyvinyl pyrrolidone, polyacrylamide, and polystyrenesulfonic acid. In addition, plasticizers for dimensional stabilization, latex polymers and matting agents can be added.

The photographic emulsions can further contain antistatics, plasticizers, brighteners, development accelerators, anti-airfoggants, toning agent, and so forth. More specifically, compounds as described in *Research Disclosure,* Vol. 176, RD-17643 (December 1978) can be used.

The photographic emulsions can contain color couplers such as a cyan coupler, a magenta coupler, a magenta coupler, and a yellow coupler, and compounds with couplers dispersed therein. That is, they can contain compounds capable of forming color through oxidative coupling with aromatic primary amine agents (e.g., phenylenediamine derivatives and aminophenol derivatives) as the time of color development.

Magenta couplers include a 5-pyrazolone coupler, a pyrazolobenzimidazole coupler, a cyanoacetylcumaron coupler, and a closed-chain acylacetonitrile coupler. Yellow couplers include acylacetamide couplers (e.g., benzoylacetanilides and pivaloylacetanilides). Cyan couplers include a naphthol coupler and a phenol coupler. These couplers are desirably non-diffusing couplers containing a hydrophobic ballast group in the molecule thereof. The couplers may be either four-equivalent or two-equivalent relative to silver ion. Colored couplers having the effect of color correction and so-called DIR couplers releasing a development inhibitor with the progress of development can also be used.

In addition to the DIR couplers, colorless DIR coupling compounds providing a colorless coupling reaction product and releasing a development inhibitor can be used.

Of the color couplers, magenta couplers are especially preferably contained in the photographic emulsions according to the present invention. These magenta couplers may be either four-equivalent or two-equivalent. Preferred are two-equivalent magenta couplers.

Suitable examples of magenta couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,725,067, 3,770,447, 3,834,908, 3,891,445, British Pat. No. 1,047,612, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, Japanese Patent Application Nos. 121689/79, 136497/79, 163167/79, 163168/79, 31320/80, 23434/83 and Japanese Patent Application No. 45059/83.

Suitable examples of yellow couplers are described in U.S. Pat. Nos. 2,875,057, 3,265,506, 3,408,194, 3,551,155, 3,582,322, 3,725,072, 3,891,445, West German Patent No. 1,547,868, West German Patent Application Laid-Open Nos. 2,219,917, 2,261,361, 2,414,006, British Pat. No. 1,425,020, Japanese Patent Publication No. 10783/76, Japanese patent Application (OPI) Nos. 26133/72, 73147/73, 102636/76, 6341/75, 123342/75, 130442/75, 21827/76, 87650/75, 82424/77, and 115219/77.

Suitable examples of cyan couplers are described in U.S. Pat. Nos. 2,369,929, 2,434,272, 2,474,293, 2,521,908, 2,895,826, 3,034,892, 3,311,476, 3,458,315, 3,576,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/83, 146828/76, 69624/77, 90932/77, 109630/78, Japanese Patent Application Nos. 20432/83 and Japanese Patent Application No. 42671/83.

Cyan couplers having an ureido group which are improved in resistance to discoloration of dyes are preferred since they improve light and heat-fastness. Examples are described in U.S. Pat. Nos. 3,446,622, 3,758,308, 3,880,661, 3,996,253, Japanese Patent Application (OPI) No. 65134/81, Japanese Patent Application Nos. 196676/81, 1620/82, and 72202/82.

As colored couplers, the compounds described, for example, in U.S. Pat. Nos. 2,521,908, 3,034,892, 3,476,560, Japanese Patent Publication Nos. 2016/69, 22335/63, 11304/67, 32461/69, Japanese Patent Application (OPI) Nos. 26034/76, 42121/77, and West German Patent Application (OLS) No. 2,418,959 can be used.

As DIR couplers, the compounds described, for example, in U.S. Pat. Nos. 3,227,554, 3,617,291, 3,632,345, 3,701,783, 3,790,384, West German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76 can be used.

In addition to DIR couplers, compounds releasing a development inhibitor as the development proceeds may be incorporated into light-sensitive materials. For example, the compounds described in U.S. Pat. Nos. 3,297,445, 3,379,529, West German Patent Application (OLS) No. 2,417,914, Japanese Patent Application (OPI) Nos. 15271/77 and 9116/78 can be used.

In order to satisfy the characteristics required for light-sensitive materials, two or more of the above-described couplers can be used in the same layer, or the same compound can be added to two or more layers.

The above-described couplers can be divided into two groups: couplers containing a water-soluble group such as a carboxyl group, a hydroxyl group and a sulfo group, and hydrophobic couplers. Both types of couplers are incorporated into emulsions by the conventionally employed methods of addition or dispersion. For example, in the case of the hydrophobic couplers, the following can be used: a method in which the couplers are mixed with high boiling organic solvents such as phthalic acid esters, trimellittic acid esters, phosphoric acid esters, fatty oils which are liquid at ordinary temperature, and wax, and then dispersed therein by the aid of anionic surfactants (as described in U.S. Pat. Nos. 2,304,939 and 2,322,027): a method in which the couplers are mixed with low boiling organic solvents or water-soluble organic solvents and then dispersed therein (as described in U.S. Pat. Nos. 2,801,170, 2,801,171, and 2,949,360): and a method in which, when the couplers themselves have a sufficiently low melting point (preferably 75° C. or lower), they are dispersed singly or in admixture with other couplers to be used in combination, such as colored couplers and DIR couplers (as described in German Pat. No. 1,143,707). In the case of the water-soluble couplers, they can be added in the form of alkali solution, or can be added in admixture with hydrophobic couplers as dispersion aids for the hydrophobic couplers, i.e., as anionic surfactants.

Color images can be formed by developing with color developers containing diffusible couplers.

As irradiation-preventing dyes which are used depending on the purpose for which the ultimate light-sensitive material is used, for example, the compounds described in Japanese Patent Publication Nos. 20389/66, 3504/68, 13168/68, U.S. Pat. Nos. 2,697,037, 2,865,752, 3,423,207, British Pat. Nos. 1,030,392 and 1,100,546 can be used.

The present invention is applicable not only to black and white photographic emulsions but also to silver halide emulsions for use in various types of color light-sensitive materials. These emulsions include color positive emulsions, color paper emulsions, color negative emulsions, color reversal emulsions (including or not including couplers), emulsions for use in the color diffusion transfer process (as described in U.S. Pat. Nos. 2,983,606, 3,087,817, 3,185,567, 3,227,550, 3,227,551, 3,227,552, 3,253,915, 3,415,644, 3,415,645 and 3,415,646), emulsion for use in the dye transfer process (as described in U.S. Pat. No. 2,882,156), and emulsions for use in the silver dye bleaching method (as described in Friedman, *History of Color Photography,* American Photographic Publishers Co., (1944), Chapter 24 and *British Journal of Photography,* Vol. 111, pages 308–309 (Apr. 7, 1964)).

Light-exposure to obtain photographic images can be performed by the usual method. That is, any of a wide variety of known light sources such as natural light(sun light), a tungsten lamp, a fuorescent lamp, a mercury lamp, a xenon arc lamp, a carbon arc lamp, a xenon flash lamp, and a cathode ray tube flying spot can be used. The exposure time may be, of course, from 1/1,000 to 1 second which is used in the usual camera. In addition, the exposure time may be shorter than 1/1,000 second, for example, from $1/10^4$ to $1/10^6$ second when the xenon flash lamp or cathode ray tube is used, or may be longer than 1 second. If necessary, a color filter can be used to control the spectral composition of light for use in the exposure. Laser light can be used for exposure process. Furthermore, light generated from a fluorescent body excited by electron rays, X-rays, $\gamma$-rays, $\alpha$-rays, and so forth can be employed.

The layer structure of multi-layer color light-sensitive materials which can be used according to the present invention is not particularly critical. For example, a blue-sensitive layer (B), a green-sensitive layer (G), and a red-sensitive layer (R) may be coated on a support in the sequence (B)-(G)-(R), (R)-(G)-(B) or (B)-(R)-(G). In a case in which the layers are coated in the order (R)-(G)-(B), it is desirable to provide an yellow filter between the layers (G) and (B).

These silver halide photographic emulsions are coated on the support, if desired, in combination with other photographic layers. Coatings can be formed by techniques such as dip coating, air knife coating, curtain coating, and extrusion coating using a hopper as described in U.S. Pat. No. 2,681,294.

If necessary, two or more layers can be coated simultaneously by techniques such as the methods described in U.S. Pat. Nos. 2,761,791, 2,941,898, 3,508,947 and 3,526,528.

Finished emulsions are coated on a suitable support.

The term "support" as used herein means a plate-formed material undergoing no significant dimensional changes during processing, including a hard support made of glass, metal or porcelain, and a flexible support. Typical flexible supports include those commonly used in the fabrication of photographic light-sensitive materials, such as a cellulose nitrate film, a cellulose acetate film, a cellulose acetate butylate film, a cellulose acetate propionate film, a polystyrene film, a polyethylene terephthalate film, a polycarbonate film, or their laminated materials, a thin glass film, and paper. In addition, paper on which baryta or $\alpha$-olefin polymers, particularly polyethylene, polypropylene, and an ethylene/butene copolymer, or polymers of $\alpha$-olefins having from 2 to 10 carbon atoms are coated or laminated, and plastic films which are improved in adhesion to other polymeric substances and further inprinting properties by coarsening the surface thereof as described in Japanese Patent Publication No. 19068/72 can be used with good results.

A transparent support or an opaque support is chosen depending on the purpose for which the light-sensitive material is used. Not only a colorless transparent support but also a colored transparent support prepared by adding dyes, or pigments can be used. Such coloring with the dyes or pigments has been conducted, for example, in X-ray films and is known as described in *Journal of the Society of Motion Picture and Television Engineers,* Vol. 67, page 296 (1958).

Opaque supports include, as well as paper which is originally opaque, films which are prepared by adding dyes or pigments, such as titanium oxide, to transparent films, plastic films which are surface-treated by a method as described in Japanese Patent Publication No. 19068/72, and paper and plastic films which are made completely opaque by adding carbon black, dyes and so forth. When the adhesion force between the support and the photographic emulsion layer is poor, a layer showing adhesion to both the layers can be provided as a subbing layer. In order to improve the adhesion properties, preliminary treatments such as corona discharging, irradiation with ultraviolet rays, and treatment with flame may be applied to the surface of the support.

These light-sensitive materials can be processed by known methods. Known processing solutions can be used. The processing temperature is typically chosen within the range of from 18° to 50° C. Temperatures higher than 50° C. or lower than 18° C. can also be used. Depending on the purpose, either of a black and white development to form a silver image and a color photographic treatment including a development to form a color dye can be applied.

Developers for use in the black and white photographic treatment can contain the known developing agents. Developing agents which can be used include dihydroxygenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds such as the compound resulting from condensation of a 1,2,3,4-tetrahydroquinone ring and an indolene ring as described in U.S. Pat. No. 4,067,872. These compounds can be used singly or in combination with each other. The developers usually further contain known additives such as preservatives, alkali agents, pH buffers, and antifoggants, and if necessary, may contain dissolving aids, toning agent, development accelerators, surfactants, defoaming agents, hard water-softening agents, hardening agents, tackifiers, and so forth.

So-called "lith type" development can be applied to the photographic emulsions of the present invention. This "lith type" development refers to a developing treatment in which in the photographic reproduction of line images or photographic reproduction of half tone images in the form of dots, dihydroxybenzenes are usually used as developing agents and the development is carried out infectiously at a low fulfite ion concentration (the details of this development is described in Mason, *Photographic Processing Chemistry, pages* 163–165 (1966)).

Fixing agents having the commonly used compositions can be used. As fixing agents, as well as thiosulfuric acid salts and thiocyanic acid salts, organic sulfur compounds which are known to be effective as fixing agents can be used. Fixers may contain water-soluble aluminum salts as hardening agents.

Dye images can be formed by the usual methods. For example, the negative-positive method (described in, for example, *Journal of the Society of Motion Picture and Television Engineers,* Vol. 61, pages 667–701 (1953)), the color reversal method in which a negative silver image is formed by developing with a developer containing a black and white developing agent, is subjected to at least one uniform light-exposure or other suitable fogging treatments, and subsequently is color-developed to obtain a dye positive image, and the silver dye bleach method in which a photographic emulsion layer containing a dye is exposed to light and developed to form a silver image, and with this silver image as a bleaching catalyst, the dye is bleached, can be employed.

The silver halide photographic light-sensitive materials of the present invention can be color-developed with aromatic primary amine compounds such as p-phenylenediamine derivatives. Typical examples of color developers include inorganic acid salts of N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)-amino]aniline, 3-methyl-4-amino-N-ethyl-N-(β-hydroxyethyl)-aniline, and the like, 4-amino-3-methyl-N-ethyl-N-(β-methanesulfoamidoethyl)aniline sesquisulfate monohydrate as described in U.S. Pat. No. 2,193,015, N-(2-amino-5-diethylaminophenylethyl)-methanesulfoamide sulfuric acid salts and N,N-dimethyl-p-phenylenediamine hydrochloric acid salts as described in U.S. Pat. No. 2,592,364, and 3-methyl-4-amino-N-ethyl-N-methoxyethylaniline as described in Japanese Patent Application (OPI) No. 64933/73.

These color developing agents are described in detail, for example, in L. F. A. Mason, *Photographic Processing Chemistry,* Focal Press Corp., London (1966), pages 226–229. They can also be used in combination with 3-pyrazolidones.

Various known additives can be added to the color developers if desired. Typical examples include alkali agents (e.g., hydroxides, carbonates and phosphates of alkali metals and ammonium), pH-adjusting agents or buffers (e.g., weak acids such as acetic acid and boric acid, weak bases, and their salts), development accelerators (e.g., pyridinium compounds, cationic compounds, potassium nitrate, and sodium nitrate as described in U.S. Pat. Nos. 2,648,604 and 3,671,247, polyethylene glycol condensates and their derivatives as described in U.S. Pat. Nos. 2,533,990, 2,577,127, and 2,950,970, nonionic compounds such as polythioethers, as exemplified by the compounds described in British Pat. Nos. 1,020,032, and 1,020,033, polymeric compounds containing a sulfite ester groups as exemplified by the compounds described in U.S. Pat. No. 3,068,097, pyridine, ethanolamines, organic amines, benzyl alcohol, and hydrazines), antifoggants (e.g., alkali bromides, alkali iodides, nitrobenzimidazoles as described in U.S. Pat. Nos. 2,496,940 and 2,656,271, mercaptobenzimidazole, 5-methylbenztriazole, 1-phenyl-5-mercaptotetrazole, compounds for rapid-processing solutions as described in U.S. Pat. Nos. 3,113,864, 3,295,976, 3,342,596, 3,597,199, 3,615,522, and thiosulfonyl compounds as described in British Pat. No. 972,211, phenazine-N-oxides as described in Japanese Patent Publication No. 41675/71, and the antifoggants described in *Kagaku Shashin Binran* (Manual of Photographic Science), Maruzen Tokyo (1959), Vol. 2, pages 29–47, stain or sludge-preventing agents as described in U.S. Pat. Nos. 3,161,513, 3,161,514, British Pat. Nos. 1,030,442, 1,251,558 and 1,144,481, multi-layer effect accelerators as described in U.S. Pat. No. 3,536,487, and preservatives (e.g., sulfurous acid salts, acidic sulfurous acid salts, hydroxylamine hydrochloric acid salts, formsulfite, and alkanolamine/sulfite adducts).

The silver halide photographic emulsions are fixed in the usual manner after development: in some cases, they are bleached. The bleaching and fixing may be performed simultaneously, or they may be performed separately. When the bleaching and fixing are performed at the same time, a bleach-fix bath containing bleaching agents and fixing agents is used. A number of compounds can be used as bleaching agents. Typical examples are ferricyanic acid salts, perchromic acid salts, water-soluble cobalt (III) salts, water-soluble copper (II) salts, water-soluble quinones, nitrosophenol, compounds of multivalent metal compounds, such as iron (III), cobalt (III) and copper (II), particularly complex salts of these multivalent metal cations and organic acids, such as metal complex salts of aminopolycarboxylic acids (e.g., ethylenediaminetetraacetic acid, nitrilotriacetic acid, iminodiacetic acid, and N-hydroxyethylethylene-diaminetriacetic acid), malonic acid, tartaric acid, malic acid, diglycolic acid, and dithioglycolic acid, and a 2,6-dipicolic acid copper complex salt, peracids such as alkylperacids, persulfuric acid salts, permanganic acid salts and hydrogen peroxide, and hypochlorous acid salts such as chlorine, bromine and bleaching powder. These compounds can be used singly or in combination with each other. These bleaching and fixing, or bleach-fixing are described in U.S. Pat. No. 3,582,322. Various additives such as bleach accelerators as described in U.S. Pat. Nos. 3,042,522, 3,241,966 and Japanese Patent Publication Nos. 8506/70 and 8836/70 can be added.

The present invention is applicable to low silver content light-sensitive materials in which the amount of silver halide in the emulsion is of the order of 1/10 to 1/100 that used in conventional light-sensitive materials. On these color light-sensitive materials of reduced silver content can be formed satisfactory color images by techniques such as a developing method in which developed silver formed by color development is subjected to halogenation bleaching and then color development is again applied to increase the amount of dye being formed (as described in U.S. Pat. Nos. 2,623,822 and 2,814,565), an image-forming method in which the amount of dye being formed is increased by utilizing color intensification using peroxides or cobalt complex salts (as described in West German Patent Application (OLS) Nos. 1,598,076, 1,900,540, 1,900,864, 1,917,744, 2,044,833, 2,056,360, 2,226,770, 2,357,694, 2,357,695, U.S. Pat. Nos. 3,674,490, 3,761,265, 3,765,890, and Japanese Patent Application (OPI) Nos. 9728/73, 9729/73, 84239/74, and 84240/74), and an image-forming method in which the amount of dye being formed is increased by utilizing color intensification using chlorous acid or bromous acid (as described in Japanese Patent Application (OPI) Nos. 53826/76 and 99022/76).

The present invention is described in detail with reference to the following examples, although the present invention is not limited thereto.

EXAMPLE 1

Silver halide grains precipitated by the double jet process were subjected to physical aging, de-salting treatment and then further to chemical aging to prepare a silver iodobromide (iodine content: 7.5 mol%) emulsion. The mean grain size of the silver halide grains was 0.85 micron. The silver halide content was 0.62 mole per kilogram of the emulsion.

One kilogram of the emulsion was weighed out and melted by heating at 40° C., and the predetermined amounts of sensitizing dyes and methanol solutions of compounds of the general formula (II) as shown in Tables 1 and 2 were added thereto and the resulting mixture was then stirred. In addition, 15 ml of a 1.0% by weight aqueous solution of 4-hydroxy-6-methyl-1,3,3a,7-tetrazaindene, 20 ml of a 1.0% by weight aqueous solution of sodium 1-hydroxy-3,5-dichlorotriazine, and then 10 ml of a 1.0% by weight aqueous solution of sodium dodecylbenzenesulfonate were added and stirred.

The thus-prepared emulsion was coated on a cellulose triacetate film support in a dry film thickness of 5 microns and then dried to form a light-sensitive material.

This light-sensitive material was exposed wedgewise by the use of a sensitometer with a light source of color temperature 5,400° K. as equipped with an yellow filter [SC-50 (Trade Name), manufactured by Fuji Photo Film Co., Ltd.]. After exposure, the material was developed with a developer having the composition as described hereinafter at 20° C. for 3 minutes, stopped, fixed and further rinsed to obtain a strip with a given black and white image. The material was measured for the density by the use of a densitometer Model P (Trade Name; manufactured by Fuji Photo Film Co., Ltd.) to determine its sensitivity and fog. The sensitivity was determined with an optical density (fog=+0.20) as a base.

| Composition of Developer | |
|---|---|
| Water | 500 ml |
| N—Methyl-p-aminophenol | 2.2 g |
| Anhydrous sodium sulfite | 96.0 g |
| Hydroquinone | 8.8 g |
| Sodium carbonate monohydrate | 56.0 g |
| Potassium bromide | 5.0 g |
| Water to make | 1,000 ml |

The results are shown in Tables 1 and 2 as relative values. It can be seen from the results that the combinations of the present invention provide superior light-sensitive materials which are of high sensitivity and are reduced in fog compared with the control and comparative light-sensitive materials.

TABLE 1

| Run No. | Sensitizing Dye Type | Sensitizing Dye Amount ($\times 10^{-5}$ mole/kg emulsion) | Compound Type | Compound Amount ($\times 10^{-5}$ mole/kg emulsion) | Sensitivity | Fog |
|---|---|---|---|---|---|---|
| 1 | I-12 | 20 | — | | 100 (base) | 0.04 |

TABLE 1-continued

| Run No. | Sensitizing Dye Type | Sensitizing Dye Amount ($\times 10^{-5}$ mole/kg emulsion) | Compound Type | Compound Amount ($\times 10^{-5}$ mole/kg emulsion) | Sensitivity | Fog |
|---|---|---|---|---|---|---|
| 2 | " | 20 | II-1 | 20 | 129 | 0.03 |
| 3 | " | 20 | " | 40 | 136 | 0.04 |
| 4 | " | 20 | " | 80 | 142 | 0.04 |
| 5 | " | 20 | II-2 | 20 | 139 | 0.03 |
| 6 | " | 20 | " | 40 | 188 | 0.03 |
| 7 | " | 20 | " | 80 | 186 | 0.04 |
| 8 | " | 20 | II-4 | 20 | 118 | 0.04 |
| 9 | " | 20 | " | 40 | 134 | 0.03 |
| 10 | " | 20 | " | 80 | 139 | 0.03 |
| 11 | " | 20 | II-6 | 20 | 121 | 0.03 |
| 12 | " | 20 | " | 40 | 135 | 0.04 |
| 13 | " | 20 | " | 80 | 154 | 0.03 |
| 14 | " | 20 | II-8 | 20 | 128 | 0.04 |
| 15 | " | 20 | " | 40 | 145 | 0.04 |
| 16 | " | 20 | " | 80 | 160 | 0.04 |
| 17*1 | " | 20 | Compound A*2 | 20 | 100 | 0.05 |
| 18*1 | " | 20 | Compound A*2 | 40 | 98 | 0.06 |
| 19*1 | " | 20 | Compound A*2 | 80 | 102 | 0.07 |
| 20*1 | Dye B*3 | 20 | II-2 | 20 | 62 | 0.05 |
| 21*1 | " | 20 | " | 40 | 65 | 0.05 |
| 22*1 | " | 20 | " | 80 | 67 | 0.06 |

Note:
*1Run Nos. 17 to 22: Comparative examples
*2Compound A: Compound described in British Patent 1,098,74
*3Compound B:

Compound A

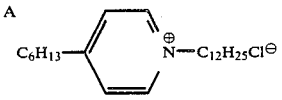

Compound B

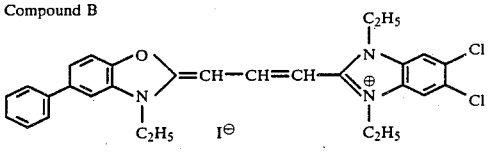

TABLE 2

| Run No. | Sensitizing Dye Type | Sensitizing Dye Amount ($\times 10^{-5}$ mole/kg emulsion) | Compound Type | Compound Amount ($\times 10^{-5}$ mole/kg emulsion) | Sensitivity | Fog |
|---|---|---|---|---|---|---|
| 1 | — | | II-2 | 40 | — | 0.03 |
| 2 | I-2 | 5 | " | 40 | 100 (base) | 0.04 |
| 3 | " | 10 | " | 40 | 132 | 0.04 |
| 4 | " | 15 | " | 40 | 138 | 0.04 |
| 5 | I-11 | 5 | " | 40 | 125 | 0.03 |
| 6 | " | 10 | " | 40 | 170 | 0.04 |
| 7 | " | 15 | " | 40 | 175 | 0.04 |
| 8 | I-7 | 5 | " | 40 | 124 | 0.04 |
| 9 | " | 10 | " | 40 | 165 | 0.03 |
| 10 | " | 15 | " | 40 | 179 | 0.04 |
| 11 | I-9 | 5 | " | 40 | 115 | 0.03 |
| 12 | " | 10 | " | 40 | 140 | 0.03 |
| 13 | " | 15 | " | 40 | 163 | 0.03 |
| 14 | I-13 | 5 | " | 40 | 101 | 0.04 |
| 15 | " | 10 | " | 40 | 141 | 0.04 |
| 16 | " | 15 | " | 40 | 166 | 0.04 |

Note:
The symbol (—) in the column of sensitivity value indicates that the sensitivity is too low to measure.

EXAMPLE 2

A multi-layer color light-sensitive film was prepared by coating the first layer (lowermost layer) to the sixth layer (uppermost layer) as shown in Table 3 on a cellulose triacetate film support.

TABLE 3

| | Coating Amount |
|---|---|
| Sixth Layer (Protective Layer) | |
| Gelatin | 750 mg/m$^2$ |
| Fifth Layer | |
| Silver chlorobromide emulsion (silver bromide: 30 mol %) | 500 mg/m$^2$ (calculated as silver) |
| Potassium bromide | 10 mg/m$^2$ |
| Magenta coupler (*1) | 600 mg/m$^2$ |
| Coupler solvent (*2) | 110 mg/m$^2$ |
| Gelatin | 1,300 mg/m$^2$ |
| Fourth Layer (Intermediate Layer) | |
| Gelatin | 500 mg/m$^2$ |
| Third Layer (Red-Sensitive Layer) | |
| Silver chlorobromide (silver bromide: 30 mol %) | 500 mg/m$^2$ (calculated as silver) |
| Sensitizing dye (*3) | 0.13 mg/m$^2$ |
| Cyan coupler (*4) | 1,500 mg/m$^2$ |
| Coupler solvent (*5) | 700 mg/m$^2$ |
| Gelatin | 2,900 mg/m$^2$ |
| Second Layer (Intermediate Layer) | |
| Gelatin | 500 mg/m$^2$ |
| First Layer (Blue-Sensitive Layer) | |
| Silver iodobromide emulsion (silver iodide: 0.2 mol %) | 1,000 mg/m$^2$ (calculated as silver) |
| Sensitizing dye (*6) | 0.2 mg/m$^2$ |
| Stabilizer (*7) | 4 mg/m$^2$ |
| Yellow coupler (*8) | 1,200 mg/m$^2$ |
| Coupler solvent (*2) | 600 mg/m$^2$ |
| Gelatin | 2,200 mg/m$^2$ |
| Support | |
| Cellulose triacetate | |

Note:
(*1) Coupler: 3-[3-{2-(2,4-Di-tert-amylphenoxy)acetamido}-benzamido]-1-(2,4,6-trichlorophenyl)-2-pyrazoline-5-one (used in the form of a dispersion in the solvent)
(*2) Solvent: Tricresyl phosphate
(*3) Sensitizing Dye: 3,3'-Di(3-sulfopropyl)-5,5',6,6',10-heptamethyl-thiadicarbocyanine sodium salt (used as a methanol solution)
(*4) Coupler: 2-[α-(2,4-Di-tert-pentylphenoxy)butaneamido]-4,6-dichloro-5-methylphenol (used in the form of a dispersion in the solvent)
(*5) Solvent, Dibutyl phthalate
(*6) Sensitizing dye: 3-Phenyl-5-{3-(3-sulfopropyl)-2-benzooxazolinilidene}rhodanine sodium salt (used as a methanol solution)
(*7) Stabilizer: 4-Hydroxy-6-methyl-1,3,3,a,7-tetraazaindene
(*8) Coupler: α-Pivaloyl-α-(2,4-dioxy-5,5'-dimethyloxazolidine-3-yl)-2-chloro-5-[α-(2,4-di-tert-pentyloxy)butaneamido]acetanilide (used in the form of a dispersion in the solvent)

The fifth layer contained the predetermined amounts of sensitizing dye of the general formula (I) and compound of the general formula (II) as shown in Table 4.

Eight types of light-sensitive materials were prepared. Each sample was stored under two different conditions, at room temperature (20° C.) and a relative humidity of 60% for 2 days and at a temperature as high as 50° C. and a relative humidity as high as 80% for 2 days. Then the sample was subjected to continuous wedge exposure by the use of a green filter and then to the following color development:

| | Temperature (°C.) | Time (sec) |
|---|---|---|
| Color development | 36 | 180 |
| Stopping | 36 | 40 |
| First-fixing | 36 | 40 |
| Bleaching | 36 | 60 |
| Second-fixing | 36 | 40 |
| Rinsing | 30 | 30 |
| Composition of Color Developer | | |
| Sodium sulfite | | 5 g |
| 4-Amino-3-methyl-N,N—diethylaniline | | 3 g |
| Sodium carbonate | | 20 g |
| Potassium bromide | | 2 g |
| Water to make | | 1 liter (pH, 10.5) |
| Composition of Stopping Solution | | |
| Sulfuric acid (6N) | | 50 ml |
| Water to make | | 1 liter (pH, 1.0) |
| Composition of Fixer | | |
| Ammonium thiosulfate | | 60 g |
| Sodium sulfite | | 2 g |
| Sodium hydrogensulfite | | 10 g |
| Water to make | | 1 liter (pH, 5.8) |
| Composition of Bleaching Solution | | |
| Potassium ferricyanide | | 30 g |
| Potassium bromide | | 15 g |
| Water to make | | 1 liter (pH, 6.5) |

The density was measured by the use of a densitometer Model P (manufactured by Fuji Photo Film Co., Ltd.). The sensitivity was determined with an optical density (fog=1.0) as a base. The results are shown in Table 4.

TABLE 4

| | Sensitizing Dye | | Compound of Formula (11) | | Storage at Room Temperature | | Storage of High Temperature and Humidity | |
|---|---|---|---|---|---|---|---|---|
| Sample | Type | Amount (× 10$^{-5}$ mole/kg emulsion) | Type | Amount (× 10$^{-5}$ mole/kg emulsion) | Sensitivity | Fog | Sensitivity | Fog |
| 1 | I-5 | 15 | — | | 100 (base) | 0.04 | 75 | 0.04 |
| 2 | — | | II-5 | 40 | — | 0.04 | — | 0.04 |
| 3 | — | | " | 80 | — | 0.04 | — | 0.04 |
| 4 | I-5 | 15 | II-5 | 40 | 126 | 0.04 | 124 | 0.04 |
| 5 | " | 15 | " | 80 | 132 | 0.04 | 129 | 0.04 |
| 6*1 | I-5 | 15 | Compound A*2 | 40 | 98 | 0.04 | 70 | 0.05 |
| 7*1 | " | 15 | " | 80 | 101 | 0.05 | 73 | 0.06 |
| 8 | I-12 | 15 | — | | 109 | 0.04 | 88 | 0.04 |
| 9 | " | 15 | II-2 | 40 | 136 | 0.04 | 134 | 0.04 |
| 10 | " | 15 | " | 80 | 146 | 0.04 | 141 | 0.04 |

Note:
*1Samples 6 and 7: Comparative samples
*2Compound A: Same as Compound A used in Example 1

It can be seen from the results shown in Table 4 that the combinations of the present invention produce superior light-sensitive materials which are of high sensitivity and are reduced in fog compared with those of the control and comparative light-sensitive materials.

What is claimed is:

1. A silver halide color photographic emulsion containing at least one sensitizing dye represented by formula (I), and at least one compound represented by formula (II), wherein formula (I) is

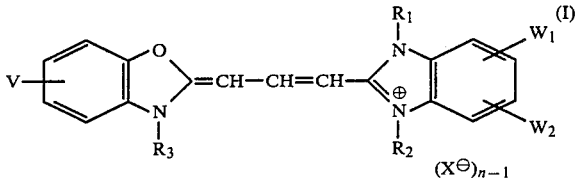

(I)

wherein V is a hydrogen atom, an alkyl group, an alkoxy group, a halogen atom, a phenyl group, a carboxyl group, a hydroxyl group, an alkoxycarbonyl group or forms a condensed benzene ring; $W_1$ and $W_2$ may be the same or different and are each a hydrogen atom, a halogen atom, an aliphatic hydrocarbon group, an acyl group, an acyloxy group, an alkoxycarbonyl group, a carbamoyl group, a substituted carbamoyl group, a sulfamoyl group, a substituted sulfamoyl group, a cyano group, a trifluoromethyl group, a hydroxyl group, or an alkylsulfonyl group; $R_1$, $R_2$ and $R_3$ may be the same or different and are each an alkyl group or a substituted alkyl group, provided that at least one of $R_2$ and $R_3$ is a substituted alkyl group containing a sulfo group or a carboxyl group; X is an acid anion; and n is 1 or 2; and wherein formula (II) is

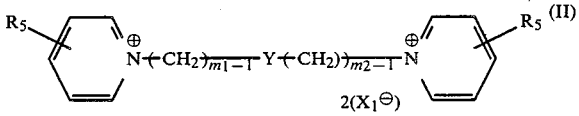

(II)

wherein $R_5$ is a hydrogen atom, a halogen atom, an alkyl group, an alkoxycarbonyl group, an acyloxy group, an alkoxyl group, an amino group, a substituted amino group, an acyl amide group, an alkane sulfonyl amide group or a carbamoyl group; Y is alkylene, arylene, aralkylene, —COO—, or —COO$Y_1$—OCO—, where $Y_1$ contains from 1 to 18 carbon atoms and is alkylene, arylene, or aralkylene; $X_1$ is an anion; and $m_1$ and $m_2$ may be the same or different and are each an integer of from 1 to 19, and wherein said emulsion contains a color forming material.

2. A silver halide color photographic emulsion as in claim 1, wherein V is located at the 5- or 6-position.

3. A silver halide color photographic emulsion as in claim 1, wherein

V is a hydrogen atom, an alkyl group having 1 to 8 carbon atoms, an alkoxy group having 1 to 8 carbon atoms, a halogen atom, a phenyl group, a carboxyl group, a hydroxyl group, an alkoxycarbonyl group having 2 to 8 carbon atoms, or forms a condensed benzene ring;

$W_1$ and $W_2$ may be the same or different and are each a hydrogen atom, a halogen atom, an aliphatic hydrocarbon group selected from an alkyl group, an allyl group, and a cyclic alkyl group having 6 or less carbon atoms, an acyl group having 8 or less carbon atoms, and acyloxy group having 3 or less carbon atoms, and alkoxycarbonyl group having 8 or less carbon atoms, a carbamoyl group, a substituted carbamoyl group having 2 to 12 carbon atoms, a sulfamoyl group, a substituted sulfamoyl group having 1 to 12 carbon atoms, a cyano group, a trifluoromethyl group, a hydroxyl group, or an alkylsulfonyl group having 1 to 4 carbon atoms;

$R_1$, $R_2$ and $R_3$ may be the same or different and are each an alkyl group having 8 or less carbon atoms, a substituted alkyl group having 6 or less carbon atoms and a substituent selected from the group consisting of —$COO^-$, —COOM, —$SO_2^-$, —$SO_3M$ (wherein M represents H, Na and K), —COOH.A, —$SO_3H$.A (wherein A represents an organic base) a cyano group, a halogen atom, a hydroxyl group, an alkoxycarbonyl group having 8 or less carbon atoms, an alkoxy group having 7 or less carbon atoms, an aryloxy group having 6 to 16 carbon atoms, an acyloxy group having 3 or less carbon atoms, an acyl group having 8 or less carbon atoms, a carbamoyl group, a substituted carbamoyl group having 1 to 12 carbon atoms, a sulfamoyl group, a substituted sulfamoyl group having 1 to 12 carbon atoms, or an aryl group or a substituted aryl group having 6 to 16 carbon atoms, at least one of $R_2$ and $R_3$ is a substituted alkyl group containing a sulfo group or a carboxyl group;

X is an acid anion; and n is 1 when the sensitizing dye of formula (I) forms an intramolecular salt, and is otherwise 2.

4. A silver halide color photographic emulsion as in claim 1, wherein $X^-$ represents an anion selected from the group consisting of Cl, F, Br, I, p-toluene sulfonic acid, p-chlorobenzene sulfonic acid, ethyl sulfuric acid and perchlorate ions.

5. A silver halide color photographic emulsion as in claim 1, wherein $W_1$ and $W_2$ each is a halogen atom, a cyano group, or a trifluoromethyl group, and V is a phenyl group, a halogen atom, or a condensed benzene ring.

6. A silver halide color photographic emulsion as in claim 1, wherein $R_5$ is a hydrogen atom, a halogen atom, an alkyl group having 1 to 18 carbon atoms, an alkoxycarbonyl group having 2 to 18 carbon atoms, an acyloxy group having 2 to 18 carbon atoms, an alkoxy group having 1 to 18 carbon atoms, an amino group, a substituted amino group having 1 to 10 carbon atoms, an acylamide group having 2 to 10 carbon atoms, an alkane sulfoneamide having carbon atoms of less than 12, a carbamoyl group, or a substituted carbamoyl group having 2 to 12 carbon atoms;

Y is an alkylene group having 1 to 18 carbon atoms, an arylene group having 6 to 18 carbon atoms, an aralkylene group having 7 to 18 carbon atoms, —COO—, or —COO—$Y_1$—OCO—, wherein $Y_1$ is alkylene group having 1 to 18 carbon atoms, arylene group having 6 to 18 carbon atoms, or aralkylene group having 7 to 18 carbon atoms;

$X_1$ is an anion; and $m_1$ and $m_2$ may be the same or different and are each an integer of 1 to 19.

7. A silver halide color photographic emulsion as in claim 1, wherein $X_1^-$ represents an anion selected from the group consisting of Cl, F, Br, I, p-toluene sulfonic acid, p-chlorobenzene sulfonic acid, ethyl sulfuric acid and perchlorate anions.

8. A silver halide color photographic emulsion as in claim 1, wherein the sensitizing dye represented by formula (I) is incorporated into the silver halide photographic emulsion in an amount of from $1\times10^{-6}$ to $5\times10^{-3}$ mol per mol of silver halide.

9. A silver halide color photographic emulsion as in claim 1, wherein the sensitizing dye represented by formula (I) is incorporated into the silver halide photographic emulsion in an amount of from $1\times10^{-5}$ to $2.5\times10^{-3}$ mol per mol of silver halide.

10. A silver halide color photographic emulsion as in claim 1, wherein the compound represented by formula (II) is incorporated in the silver halide photographic emulsion in an amount of from about 0.01 to about 10 m moles per mol of silver halide.

11. A silver halide color photographic emulsion as in claim 1, wherein the compound represented by formula (II) is incorporated in the silver halide photographic emulsion in an amount of from about 0.2 to about 2.5 m moles per mol of silver halide.

12. A silver halide color photographic emulsion as in claim 1, the weight ratio of the dye represented by formula (I) to the compound represented by formula (II) is from 4:1 to 1:100.

13. A silver halide color photographic emulsion as in claim 1, the weight ratio of the dye represented by formula (I) to the compound represented by formula (II) is from 2:1 to 1:40.

14. A silver halide color photographic emulsion as claimed in claim 1, wherein at least one of V, $R_2$ and $R_3$ and $W_1$ and $W_2$ is limited as follows:

V is a halogen atom, a phenyl group, a carboxyl group or forms a condensed benzene ring, one of $R_2$ and $R_3$ is a substituted alkyl group containing a sulfo group or carboxyl group, or $W_1$ and $W_2$ are each an acyl group, an acyloxy group, a carbamoyl group, a substituted carbamoyl group, a sulfamoyl group, a substituted sulfamoyl group or an alkylsulfonyl group.

15. A silver halide color photographic emulsion as in claim 1, wherein said color forming material is a color coupler.

16. A silver halide color photographic emulsion as in claim 15, wherein said coupler is a magenta coupler.

17. A silver halide color photographic emulsion as in claim 15, wherein said emulsion is green sensitive.

* * * * *